US006197470B1

(12) United States Patent
Tamura

(10) Patent No.: US 6,197,470 B1
(45) Date of Patent: Mar. 6, 2001

(54) TONER, IMAGE FORMING METHOD AND APPARATUS UNIT

(75) Inventor: Osamu Tamura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,003

(22) Filed: Feb. 22, 2000

(30) Foreign Application Priority Data

Feb. 22, 1999 (JP) ..... 11-043881
Feb. 18, 2000 (JP) ..... 2000-046808

(51) Int. Cl.[7] ..... G03G 9/08

(52) U.S. Cl. ..... 430/110; 430/111; 430/124; 399/111

(58) Field of Search ..... 430/110, 111, 430/124; 399/119, 111

(56) References Cited

U.S. PATENT DOCUMENTS 4,868,084 9/1989 Uchida et al. ..... 430/110
5,266,432 11/1993 Hayashi et al. ..... 430/109
5,422,214 * 6/1995 Akiyama et al. ..... 430/111
5,700,616 12/1997 Kasuya et al. ..... 430/110

FOREIGN PATENT DOCUMENTS 0 609 870 10/1994 (EP) .
32060 2/1985 (JP) .
139370 6/1988 (JP) .
80584 4/1993 (JP) .

* cited by examiner

*Primary Examiner*—Christopher D. RoDee
(74) *Attorney, Agent, or Firm*—Fitzpatrick, Cella, Harper & Scinto

(57) ABSTRACT

A toner is disclosed which contains toner particles and a hydrophobic fine silica powder. The hydrophobic fine silica powder has the following hydrophobic properties: the transmittance of the measuring sample fluid as defined in the specification at a methanol content of from 60% by volume to 72% by volume is 95% or more, and the transmittance of the measuring sample fluid at a methanol content of 74% by volume is 90% or more. Also, disclosed are an image forming method and an apparatus unit making use of the toner.

77 Claims, 3 Drawing Sheets

TONER, IMAGE FORMING METHOD AND APPARATUS UNIT

BACKGROUND OF THE INVENTION

1. Field of the invention

This invention relates to a toner for rendering an electrostatic latent image visible as in electrophotography, an image forming method making use of the toner, and an apparatus unit having the toner.

2. Related Background Art

In recent years, in image forming methods employing electrophotographic techniques as in copying machines and laser printers, methods are prevailing in which photosensitive members are electrostatically charged with a contact charging member without using any corona charging assembly which may generate ozone, taking environmental problems into consideration. Under such circumstances, especially in an environment of high temperature and high humidity (humidness), a phenomenon in which fine particles are brought into pressure contact with the surface of a photosensitive member by the charging member to adhere to that surface (hereinafter "drum melt-adhesion") has come to occur actually. Also, as to the fine particles as a substance causative of such a phenomenon, analytical means have ascertained that silica fine powder used as a fluidity improver of toners is one of such fine particles.

Such a problem is known to be solved to a certain extent by using a hydrophobic fine silica powder having been treated with a coupling agent comprising hexamethyldisilazane (HMDS) followed by treatment with an oil as disclosed in Japanese Patent Application Laid-open No. 63-139370 (corr. to U.S. Pat. No. 4,868,084), or using a hydrophobic fine silica powder disclosed in Japanese Patent Application Laid-open No. 5-80584. However, as a technical trend in recent years, toners are being made to have much smaller particle diameters because of demands for higher image quality, and the above phenomenon has come to occur still more. Thus, under existing circumstances, it is difficult to solve the problem completely by the use of the above treated hydrophobic fine silica powder.

In addition, a phenomenon in which a low electrical resistance substance formed from paper dust, ozone and so forth generated during printing greatly damages electrostatic latent images formed on the surface of a photosensitive member (hereinafter "smeared images") tends to occur in the case when toners are used in an environment of high temperature and high humidity. As a means for preventing such smeared images, Japanese Patent Application Laid-open No. 60-32060 discloses a toner incorporated with an inorganic fine powder having two types of BET specific surface area. However, studies made by the present inventor have revealed that any satisfactory effect of preventing smeared images can not be attained when, e.g., the above hydrophobic fine silica powder having been treated with a coupling agent comprising HMDS followed by treatment with an oil as disclosed in Japanese Patent Application Laid-open No. 63-139370 is used in the toner as one of external additives in order to prevent the drum melt-adhesion stated above, thus the effect of preventing drum melt-adhesion and the effect of preventing smeared images can not simultaneously be attained.

As another problem, the toner having a high effect of preventing smeared images as stated above can be said to be a toner that tends to abrade photosensitive drums. Use of such a toner may cause a problem of the shortening of drum service life. In such a case, under existing circumstances, a problem may further arise such that the drum surface roughs to cause a decrease in transfer efficiency, which further causes faulty cleaning of the drum and contamination of the charging roller.

SUMMARY OF THE INVENTION

An object of the present invention is to provide a toner having solved the above problems, and an image forming method and an apparatus unit which make use of the toner.

Another object of the present invention is to provide a toner that does not cause any drum melt-adhesion in every environment.

Still another object of the present invention is to provide a toner that can keep smeared images from occurring even in an environment of high temperature and high humidity.

A further object of the present invention is to provide a toner that enjoys a good transfer efficiency.

A still further object of the present invention is to provide a toner that can keep photosensitive drums from abrasion and can make the service life of photosensitive drums longer.

A still further object of the present invention is to provide an image forming method that can bring about good effects, making use of the toner.

A still further object of the present invention is to provide an apparatus unit that can bring about good effects, making use of the toner.

To achieve the above objects, the present invention provides a toner comprising toner particles and a hydrophobic fine silica powder, wherein;

the hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of the measuring sample fluid at a methanol content of from 60% by volume to 72% by volume is 95% or more; and (ii) the transmittance of the measuring sample fluid at a methanol content of 74% by volume is 90% or more.

The present invention also provides an image forming method comprising the steps of;

forming an electrostatic latent image on an electrostatic latent image bearing member;

developing the electrostatic latent image by a developing means having a toner, to form a toner image;

transferring the toner image held on the electrostatic latent image bearing member, to a transfer material via, or not via, an intermediate transfer member; and fixing by a fixing means the toner image held on the transfer material;

the toner comprising toner particles and a hydrophobic fine silica powder, wherein;

the hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of the measuring sample fluid at a methanol content of from 60% by volume to 72% by volume is 95% or more; and (ii) the transmittance of the measuring sample solution at a methanol content of 74% by volume is 90% or more.

The present invention still also provides an apparatus unit detachably mountable on a main assembly of an image forming apparatus; the unit comprising;

an electrostatic latent image bearing member for holding thereon an electrostatic latent image; and a developing means having a toner for developing the electrostatic latent image to form a toner image;

the toner comprising toner particles and a hydrophobic fine silica powder, wherein;

the hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of the measuring sample fluid at a methanol content of from 60% by volume to 72% by volume is 95% or more; and (ii) the transmittance of the measuring sample fluid at a methanol content of 74% by volume is 90% or more.

BRIEF DESCRIPTION OF THE DRAWINGS

FIG. 2 is a schematic illustration of an example of an image forming apparatus used in the image forming method of the present invention.

DESCRIPTION OF THE PREFERRED EMBODIMENTS

Figure 1:
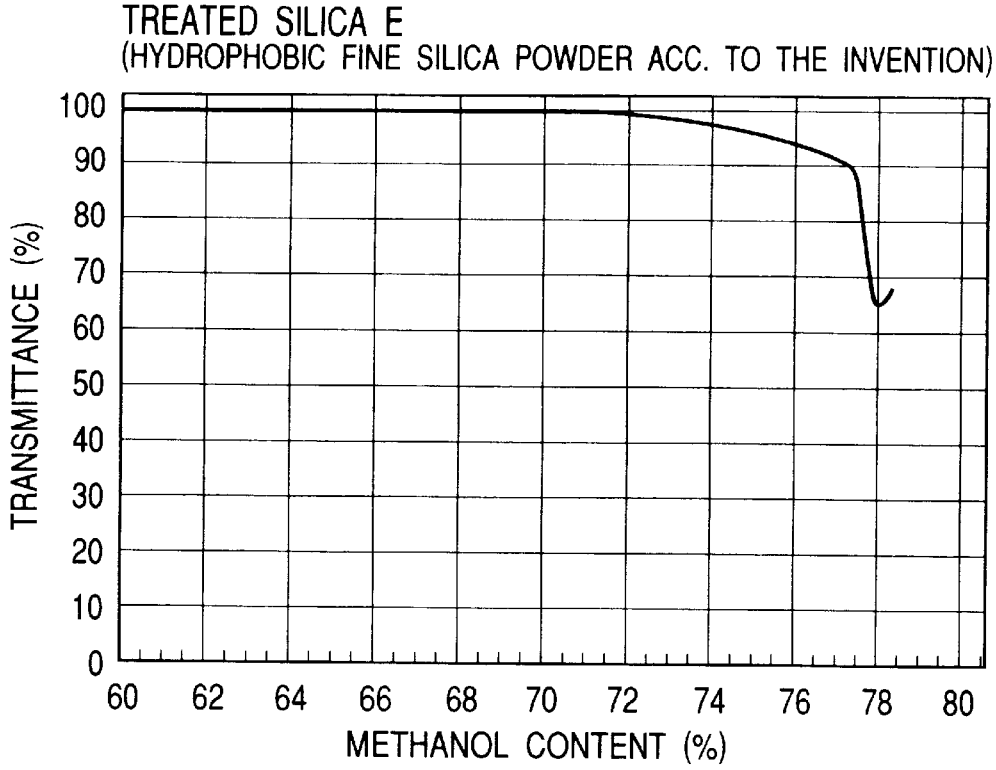
FIGS. 1-1 and 1-2 are graphs showing examples of the methanol-dropping transmittance curve.

The present invention will be described below by giving preferred embodiments of the present invention.

As discussed previously, the conventional technical means is involved in a situation that, when toners are made up, the employment of the mean that-can prevent drum melt-adhesion makes smeared images occur seriously and on the other hand the employment of the mean that can prevent smeared images makes drum melt-adhesion occur seriously, and in a situation that it is difficult to solve these problems simultaneously.

To cope with this matter, the present inventor made extensive studies from an aspect of materials that constitute toners, in order to solve the above problems. As the result, he has discovered that a fine silica powder having specific hydrophobic properties not hitherto available may be used as a hydrophobic fine silica powder to be externally added to toner particle surfaces and this can be an effective means by which the problem of drum melt-adhesion and the problem of smeared images can be solved simultaneously. Thus, he has accomplished the present invention. More specifically, in the present invention, a methanol-dropping transmittance curve prepared under specific conditions is used in measuring hydrophobic properties of the hydrophobic fine silica powder, and a hydrophobic fine silica powder being in a state that the curve meets specific requirements is used as an external additive of toner particles.

With regard to the hydrophobic properties of hydrophobic fine silica powders, a measurement method is conventionally used in which, e.g., an aqueous methanol solution in which silica has been soaked is stirred with a magnetic stirrer, methanol is added thereto using a burette and the quantity (ml) of the methanol added dropwise until the floating silica has all settled is regarded as hydrophobicity. However, according to studies made by the present inventor, it was impossible to solve the problem of drum melt-adhesion and the problem of smeared images simultaneously even with use of a silica having a high hydrophobicity measured by this method.

In contrast thereto, in the present invention, a measuring sample fluid is prepared by adding a hydrophobic fine silica powder in a specific quantity to an aqueous methanol solution having a specific concentration, and an apparatus so constructed that can continuously measure the changes in transmittance of the measuring sample fluid when a methanol solution is added dropwise thereto at a constant rate is used to specify a hydrophobic fine silica powder effective as a toner external additive that can solve the problem of drum melt-adhesion and the problem of smeared images simultaneously as intended in the present invention.

Studies made by the present inventor have revealed that the hydrophobic fine silica powder specified by the above method has physical properties as described below and hence a toner making use of such a hydrophobic fine silica powder as an external additive can be good enough to achieve the desired end of the present invention. More specifically, it has been found that the hydrophobic fine silica powder used in the present invention is a silica having achieved high hydrophobic properties not seen in any hydrophobic fine silica powders conventionally used in toners as external additives and, in addition thereto, a silica having been made uniformly hydrophobic, and that as a result of the use of the hydrophobic fine silica powder having such properties a toner can be obtained which can solve the problem of drum melt-adhesion and the problem of smeared images simultaneously. These matters will be detailed below.

First, a difference between the hydrophobic fine silica powder used in the present invention and the conventionally known hydrophobic fine silica powders as stated previously will be explained by giving an example; the difference having been ascertained as a result of studies made by the present inventor.

For example, Japanese Patent Application Laid-open No. 5-80584 discloses a hydrophobic fine silica powder having a hydrophobicity of 80 degrees or above measured by the conventional method mentioned previously. According to the description in its specification, the hydrophobic fine silica powder used in this prior art is estimated to have a transmittance of 90% or more with respect to a solution with a methanol content of 60 to 68% by volume when measured by the method of measuring hydrophobic properties as used in the present invention. In the description in its specification, however, no reference is made at all as to hydrophobic properties in a case where the methanol content is higher than 68% by volume. Hence, it can be said that any highly hydrophobic silica where the sedimentation of silica does not take place in the case where the methanol content is higher than 68% by volume is not disclosed in the above Japanese Patent Application Laid-open No. 5-80584.

As mentioned previously, Japanese Patent Application Laid-open No. 63-139370 also discloses a hydrophobic fine silica powder having been treated with a silane coupling agent followed by treatment with a silicone oil. In measurement of the same hydrophobic fine silica powder as this one by the method of measuring hydrophobic properties as used in the present invention, the transmittance in a case where the methanol content is 74% by volume was found to be less than 90% by volume. Also, as will be shown later as a comparative example of the present invention, this silica powder has a hydrophobicity clearly lower than the treated silica used in the present invention, and was unable to achieve the object of the present invention, i.e., to solve the problem of drum melt-adhesion and the problem of smeared images simultaneously.

More specifically, as a result of the above studies, it has been found that the drum melt-adhesion, the smeared images and the transfer efficiency are all improved and also the photosensitive drum may less abrade when a hydrophobic fine silica powder in the methanol-dropping transmittance curve of which the transmittance at a methanol content of from 60% by volume to 72% by volume is 95% or more and the transmittance at a methanol content of 74% by volume is 90% or more, which any conventional hydrophobic fine silica powders have been unable to satisfy, is used as an external additive of the toner; the methanol-dropping transmittance curve being obtained by the method used in the present invention to measure hydrophobic properties of hydrophobic fine silica powder. It has also been found that, in order to more surely settle the subject in the present invention, a hydrophobic fine silica powder in the methanol-dropping transmittance curve of which the transmittance at a methanol content of 75% by volume is 90% or more and, more preferably, the transmittance at a methanol content of 76% by volume is 85% or more may be used as an external additive of the toner.

From a different point of view, the matter will be explained to show that the hydrophobic fine silica powder used in the present invention is highly hydrophobic and also has been made uniformly hydrophobic.

Namely, in the methanol-dropping transmittance curve obtained by the method as described above, the transmittance is considered to decrease at a higher rate when the measuring sample fluid has a high methanol content, because the more particles which are readily wettable are present the more readily dispersible the silica particles become. In the conventional hydrophobic fine silica powder, the measuring sample fluid does not have any high transmittance of at least 90% at a methanol content of from 60 to 74% by volume, and has a transmittance in a value of about 80% at best at a methanol content of 74% by volume even in the case of treated silica which is said to have a high hydrophobicity.

Namely, even in treated silica which has hydrophobic properties to a certain extent, some groups of particles may begin to wet selectively when its hydrophobic treatment is made non-uniformly on particles, resulting in a low transmittance. If such a fine silica powder is used as an external additive of the toner, especially smeared images may occur seriously. In this respect, it becomes difficult to settle the subject of the present invention.

The hydrophobic fine silica powder according to the present invention has, as stated above, high hydrophobic properties and uniform hydrophobic properties not seen in the conventional silica.

As a common manner of using fine silica powders, the silica powder is externally added to toner particles and is made to adhere to their surfaces. In such a case, the silica having adhered to the toner particle surfaces may come off the surfaces during use to become free. When it occurs, in the case of silica conventionally used, it is considered that the free silica tends to scratch the photosensitive member surface and the scratches thus produced cause the drum melt-adhesion. On the other hand, in the case of the hydrophobic fine silica powder used in the present invention, it is considered that the silica itself is kept from being laid bare to the surface because of, as stated previously, not only its high hydrophobic properties but also the uniform hydrophobic treatment made on its particle surfaces and hence the silica particle surfaces have been made smooth, so that the silica may hardly scratch the drum surface to enable prevention of the drum melt-adhesion.

It has not been elucidated why the hydrophobic fine silica powder used in the present invention can be effective against the smeared images.

The improvement in transfer efficiency that can be achieved when the toner of the present invention is used is considered attributable to the improvement in releasability to drum surface that has been achieved more remarkably than that of conventional ones because of the external addition of the hydrophobic fine silica powder whose particle surfaces have been made uniformly hydrophobic. As the result, the toner to be removed by cleaning can be in a small quantity. It is further considered that, although the drum surface may be abraded upon contact with the toner, it can be abraded effectively without being abraded too much because of superior releasability to the drum surface to bring about the effect that the drum surface may less abrade.

As stated previously, in the toner of the present invention, the hydrophobic properties of the fine silica powder are selected using the methanol-dropping transmittance curve so that the fine silica powder that can bring about the above advantages can be specified. Stated specifically, as a measuring apparatus therefor, a powder wettability tester WET-100P, manufactured by K.K. Resuka, is used, and a methanol-dropping transmittance curve is utilized which is obtained by measuring transmittance under the following conditions.

First, a measuring sample fluid is prepared by adding the specimen hydrophobic fine silica powder precisely in an amount of 0.06 g in a container holding 70 ml of an aqueous methanol solution composed of 60% by volume of methanol and 40% by volume of water. Next, its transmittance is measured using light of 780 nm in wavelength while adding methanol dropwise at a rate of 1.3 ml/min into the measuring sample fluid, to prepare the methanol-dropping transmittance curve as shown in FIG. 1-1.

The hydrophobic fine silica powder used in the present invention, having the characteristic hydrophobic properties and specified by the method as described above will be described. First, fine silica powder as shown below may preferably be used as a base material to be subjected to hydrophobic treatment (hereinafter "base material silica").

Fine silica powder used as the base material silica includes what is called dry-process silica or fumed silica produced by vapor phase oxidation of silicon halides and what is called wet-process silica produced from water glass or the like, either of which may be used. In particular, the dry-process silica is preferred, as having less silanol groups on the surface and inside and leaving no production residue such as $Na_2O$ and $SO^3$—. In the dry-process silica, it is also possible to use, in its production step, other metal halide such as aluminum chloride or titanium chloride together with the silicon halide to give a composite fine powder of silica with other metal oxide. The fine silica powder includes these, too.

In the toner of the present invention, used as its external additive is a hydrophobic fine silica powder comprising the above fine silica powder used as the base material silica and whose particle surfaces have been made uniformly and highly hydrophobic. A hydrophobic-treating agent used here will be described below.

As the hydrophobic-treating agent for making the above base material silica hydrophobic, organosilicon compounds may preferably be used. As the organosilicon compounds usable here, silicone oils and/or silane coupling agents may preferably be used.

The silane coupling agents may include, e.g., hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

In the present invention, as the hydrophobic-treating agent of the base material silica, silicone oil or silicone varnish may also preferably be used. The silicone oil may preferably be a compound represented by Formula (I):

Formula (I)

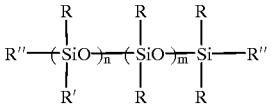

wherein R represents an alkyl group having 1 to 3 carbon atoms; R' represents a silicone oil modifying group such as alkyl, halogen-modified alkyl, phenyl or modified phenyl; R" represents an alkyl group having 1 to 3 carbon atoms or an alkoxyl group; and m and n satisfy the conditions: m≧0, n≧0, and m+n>0.

As examples of the compound represented by Formula (I), it may include dimethylsilicone oil, alkyl-modified silicone oil, α-methylstyrene-modified silicone oil, chlorophenylsilicone oil and fluorine-modified silicone oil.

In the present invention, a modified silicone oil having the structure represented by Formula (II) may also be used as the silicone oil.

Formula (II)

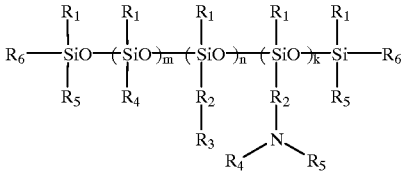

In the above Formula (II), $R_1$ and $R_6$ each represent a hydrogen atom, an alkyl group, an aryl group or an alkoxyl group; $R_2$ represents an alkylene group or a phenylene group; $R_3$ represents a group having a nitrogen-containing heterocyclic ring in its structure; and $R_4$ and $R_5$ each represent a hydrogen atom, an alkyl group or an aryl group. $R_2$ may be absent. In the foregoing, the alkyl group, the aryl group, the alkylene group and the phenylene group may each contain an amine, or may have a substituent such as a halogen as long as charging performance is not damaged. Letter symbol m is a number of 1 or more; and n and k are each a positive number inclusive of 0; provided that n+k is a positive number of 1 or more.

In the above structure, most preferred is a structure wherein the number of the nitrogen atom in the side chain containing a nitrogen atom is 1 or 2. Examples of such a structure is given below as unsaturated heterocyclic rings containing nitrogen.

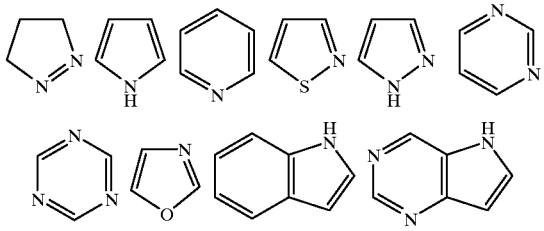

Examples of such a structure is also given below as saturated heterocyclic rings containing nitrogen.

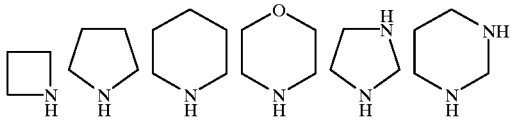

The present invention is by no means restricted by the above examples of compounds. The compounds having a heterocyclic ring structure of 5 members or 6 members are preferred.

Derivatives thereof can be exemplified by derivatives formed by introducing into the foregoing compounds a hydrocarbon group, a halogen group, an amino group, a vinyl group, a mercapto group, a methacrylic group, a glycidoxyl group or a ureido group. Any of these may be used alone or in combination of two or more types.

The silicone varnish usable in the present invention may include, for example, methylsilicone varnish and phenylmethylsilicone varnish. In particular, it is preferable in the present invention to use methylsilicone varnish. The methylsilicone varnish is a polymer comprised of a $T^{31}$ unit, a $D^{31}$ unit and an $M^{31}$ unit which are represented by the following structural formulas, and is a terpolymer containing the $T^{31}$ unit in a large quantity.

$T^{31}$ unit:

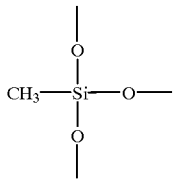

$D^{31}$ unit:

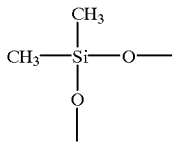

$M^{31}$ unit:

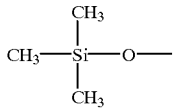

Stated specifically, the methylsilicone varnish or phenylmethylsilicone varnish is a substance having a chemical structure as represented by the following Formula (A).

Formula (A):

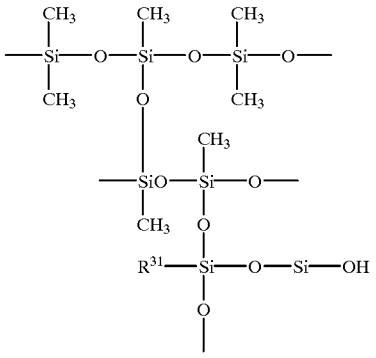

wherein $R^{31}$ represents a methyl group or a phenyl group.

In particular, in the above silicone varnish, the $T^{31}$ unit is a unit effective for imparting a good heat-curability and providing a three-dimensional network structure. The $T^{31}$ unit may preferably be contained in the silicone varnish in an amount of from 10 to 90 mol %, and particularly from 30 to 80 mol %.

Such a silicone varnish has a hydroxyl group at a terminal of its molecular chain or in the side chain thereof, and dehydration condensation of the hydroxyl group cause the compound to cure. A curing accelerator that can be used to accelerate this curing reaction may include, e.g., fatty acid salts of zinc, lead, cobalt or tin, and amines such as triethanolamine and butylamine. Of these, amines may particularly preferably be used.

To convert the above-described silicone varnish into an amino-modified silicone varnish, some methyl groups or phenyl groups present in the above $T^{31}$ unit, $D^{31}$ unit and $M^{31}$ unit may be substituted so as to form groups having an amino group. The groups having an amino group may include, but not limited to, e.g., those represented by the following structural formulas.

$—CH_2CH_2—NH_2$ $—CH_2(CH_{22}—NH_2$ $—CH_2(CH_2)_2—NH—(CH_2)_3NH_2$ $—CH_2CH_2—NH_2$ $—CH_2(CH_2)_2—NH_2$ $—CH_2(CH_2)_2—NH—(CH_2)_3NH_2$

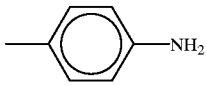

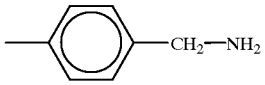

The hydrophobic treatment of the base material silica with any of these silicone oils or silicone varnishes may be made by, e.g., a method in which the fine silica powder and the silicone oil or silicone varnish are mixed by means of a mixing machine, and a method in which the silicone oil or silicone varnish is sprayed into the fine silica powder by means of an atomizer.

The above silicone oil or silicone varnish may preferably have a viscosity at 25° C. of from 10 to 2,000 centistokes, and more preferably from 30 to 1,500 centistokes. More specifically, use of those having a viscosity lower than 10 centistokes tends to make the oil become desorbed from silica particles because of a too low viscosity, which oil may adhere to toner particles to cause a decrease in fluidity of the toner, tending to cause faulty images such as fog and resulting in a low level of drum melt-adhesion preventive effect. If on the other hand the silicone oil or silicone varnish has a viscosity higher than 2,000 centistokes, it is difficult to uniformly treat the surfaces of fine silica particles because of a too high viscosity, resulting in a low level of drum melt-adhesion preventive effect.

The viscosity of the silicone oil or silicone varnish is measured using VISCOTESTER VT500 (manufactured by Haake Co.). One of several viscosity sensors for VT500 is selected (arbitrarily), and a sample to be measured is put in a measuring cell for that sensor to make measurement. The viscosity (pas) indicated on the device is calculated into cs (centistokes).

As a form of the treatment for producing the hydrophobic fine silica powder used in the present invention, having the above characteristic high hydrophobic properties, it is preferable to make treatment in combination of both the silane coupling agent and the silicone oil or silicone varnish. In particular, a preferred form of treatment is to firstly make treatment with the silane coupling agent and thereafter make treatment with the silicone oil or silicone varnish. In particular, a still preferred form of treatment is to make treatment with hexamethyldisilazane and thereafter make treatment with silicone oil.

As treatment with the silane coupling agent, it is preferable to use a dry process in which the silane coupling agent is allowed to react with fine silica powder in the presence of water vapor by bringing the former into contact with the latter having been made into a cloud.

In this treatment of fine silica powder with the silane coupling agent, the treatment with the silane coupling agent in the presence of water vapor enables uniform and high-degree hydrophobic treatment because the water vapor acts as a catalyst to enhance the reaction of the silane coupling agent. In the absence of the water vapor at the time of this treatment with the silane coupling agent, the silane coupling agent may have a low reactivity to consequently make it difficult to satisfy the above characteristic high hydrophobic properties in the present invention.

The hydrophobic treatment of the base material silica particle surfaces with the silicone oil and/or silicone varnish may be made by a method including, e.g., a method in which the fine silica powder and a silicone oil not diluted with a solvent are directly mixed by means of a mixing machine such as a Henschel mixer, and a method in which a silicone oil not diluted with a solvent is sprayed on the base material silica. In this treatment, the silicone oil and/or silicone varnish may be heated to a temperature of from 50 to 200° C. to lower their viscosity before use. This is preferable because more uniform hydrophobic treatment can be achieved.

As described above, the silicone oil and/or silicone varnish may be used in the treatment in the state they are not diluted with a solvent, and hence may preferably have the viscosity at 25° C. of from 10 to 2,000 centistokes.

In a method conventionally commonly used, the treatment is made by dissolving or dispersing silicone oil in an organic solvent and thereafter mixing it with the base material fine silica powder, followed by removal of the solvent. In such a method, the solvent may necessarily remain, and it becomes necessary to remove the solvent from the treated silica. In such a case, agglomerates of silica particles may be formed or the state of treatment may vary when the solvent is removed, to tend to cause a difficulty that the uniformity of treatment lowers. Thus, in this treatment with the silicone oil and/or silicone varnish, the use of the silicone oil and/or silicone varnish diluted with a solvent makes it difficult to satisfy the above characteristic high hydrophobic properties in the present invention.

As a method desirably used in the production of the hydrophobic fine silica powder used in the present invention, a method may preferably be used in which the fine silica powder is treated with the silane coupling agent and thereafter the silicone oil or silicone varnish is sprayed, followed by heat treatment at a temperature of 200° C. or above.

In this treatment for the hydrophobic fine silica powder, the heating at a high temperature of 200° C. or above after the treatment with the silane coupling agent and after spraying of the silicone oil or silicone varnish makes the silicone oil or silicone varnish adhere uniformly and firmly to fine silica particle surfaces, and this makes it possible for the fine silica particles to retain a high fluidity.

In the present invention, the silane coupling agent may be added in an amount ranging from 5 to 60 parts by weight, and more preferably from 10 to 50 parts by weight, based on 100 parts by weight of the base material silica, to make the hydrophobic treatment. If it is less than 5 parts by weight, the drum melt-adhesion tends to occur. If it is more than 60 parts by weight, a difficulty may arise in production.

The silicone oil or silicone varnish may be used in an amount ranging from 5 to 40 parts by weight, and more preferably from 7 to 35 parts by weight, based on 100 parts by weight of the base material silica or the treated silica. If it is less than 5 parts by weight, the drum melt-adhesion tends to occur. If it is more than 40 parts by weight, difficulties such as smeared images tend to occur.

The hydrophobic fine silica powder used in the present invention may preferably be those in which its final carbon content is in the range of from 3.0 to 13.0% by weight, and more preferably in the range of from 4.5 to 12.0% by weight. Incidentally, in the present invention, the carbon content is analyzed using a trace carbon analyzer (manufactured by Horiba K.K., Model EMIA-100).

The hydrophobic fine silica powder used in the present invention may preferably have a particle diameter of 0.1 $\mu$m or smaller, and more preferably from 5 to 50 nm, as number-average particle diameter (length average). The hydrophobic fine silica powder used in the present invention may preferably have a specific surface area of from 10 to 550 $m^2/g$, and more preferably 50 to 500 $m^2/g$ as measured by nitrogen absorption method. If the hydrophobic fine silica powder has a number-average particle diameter larger than 0.1 $\mu$m or a specific surface area smaller than 10 $m^2/g$, it may be difficult to ensure sufficient fluidity and charging performance, tending to cause problems such as image density decrease and fog.

The hydrophobic fine silica powder used in the present invention may also preferably be those having as charge quantity a negative triboelectric chargeability of from −30 to −400 $\mu$C/g to iron powder, and more preferably from −50 to −300 $\mu$C/g to iron powder, because negative triboelectric charges can well be imparted to negatively chargeable toners.

The above hydrophobic fine silica powder used in the present invention may preferably be added in a proportion of from 0.6 to 3.0 parts by weight based on 100 parts by weight of the toner particles. Its addition in an amount less than 0.6 part by weight or in an amount more than 3.0 parts by weight is not preferable because the former may make it difficult to obtain a sufficient image density and the latter may cause difficulties such as drum melt-adhesion.

In the toner of the present invention, in order to more sufficiently achieve the desired end, it is desirable to further add a second inorganic fine powder in addition to the hydrophobic fine silica powder described above. Such a second inorganic fine powder may include, e.g., iron oxide, chromium oxide, calcium titanate, strontium titanate, silicon titanate, barium titanate, magnesium titanate, cerium oxide, zirconium oxide, aluminum oxide, titanium oxide, zinc oxide and calcium oxide. In the present invention, among these, it is particularly preferable to use composite oxides. For example, it is preferable to use fine strontium titanate powder, fine calcium titanate powder or fine silicon titanate powder.

As the second inorganic fine powder, those having as primary particles a number-average particle diameter of from 0.12 to 3.0 $\mu$m may preferably be used. Primary particles having a number-average particle diameter smaller than 0.12 $\mu$m and those larger than 3.0 $\mu$m are not preferable because the former may adversely affect the effect of preventing smeared images and the latter tends to scratch the drum surface.

The second inorganic fine powder may be added to the toner of the present invention in an amount of from 0.3 to 5.0 parts by weight based on 100 parts by weight of the toner particles, in order to better settle the subject of the present invention. More specifically, its addition in an amount less than 0.3 part by weight or its addition in an amount more than 5.0 parts by weight is not preferable because the former tends to cause smeared images and the latter tends to cause drum melt-adhesion.

The number-average particle diameter of the hydrophobic fine silica powder used in the present invention and that of the second inorganic fine powder added optionally are values measured in the following way.

Using an electron microscope S-800 (manufactured by Hitachi Ltd.), first, photographs are taken at 10,000 to 20,000 magnifications in respect of the hydrophobic fine silica powder constituting the toner of the present invention and at 1,000 to 20,000 magnifications in respect of the second inorganic fine powder. Next, from the fine particles thus photographed, 100 to 200 particles are picked up at random which are 0.001 μm or larger in respect of the hydrophobic fine silica powder and 0.005 μm or larger in respect of the second inorganic fine powder. Diameters of the respective particles are measured with a measuring device such as a vernier caliper and then averaged to determine the number-average particle diameter of each inorganic fine powder.

BET specific surface area of the hydrophobic fine silica powder used in the present invention and that of a magnetic material described later are determined by the BET multi-point method, using a full-automatic gas adsorption measuring device AUTOSORB-1, manufactured by Yuasa Ionics Co., Ltd., and using nitrogen as adsorbing gas. As a pretreatment, the sample is deaerated at 50° C. for 10 hours.

In order to better settle the subject of the present invention, the toner of the present invention may preferably have a weight-average particle diameter of from 3.5 to 9.9 μm, and may more preferably have a weight-average particle diameter of from 3.5 to 6.5 μm. More specifically, toner having a weight-average particle diameter smaller than 3.5 μm or larger than 9.9 μm is not preferable because the former tends to cause drum melt-adhesion and the latter tends to cause smeared images.

In the present invention, the weight-average particle diameter of the toner and toner particles in the foregoing description is measured with a Coulter counter TA-II (manufactured by Coulter Electronics, Inc.) usually used. Coulter Multisizer (manufactured by Coulter Electronics, Inc.) may also be used. As an electrolytic solution, an aqueous 1% NaCl solution is prepared using first-grade sodium chloride. For example, ISOTON R-II (trade name, manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of 2.00 μm or larger by means of the above measuring device, using an aperture of 100 μm as its aperture. Then, as the values according to the present invention, the weight-based, weight average particle diameter (D4) and volume-average particle diameter (Dv) (in each value the middle value of each channel is used as the representative value for each channel) determined from the volume distribution, and the proportion of toner particles with diameters of 2.00 μm to 3.17 μm determined from the number distribution are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner particles constituting the toner of the present invention may also preferably be negatively chargeable particles, and may further preferably be those having a negative chargeability of from −2.0 to −50 μC/g to iron powder.

In the present invention, the charge quantity (quantity of triboelectricity) of the hydrophobic fine silica powder, toner particles and toner to iron powder is measured in the following way.

A measuring sample (0.2 g in the case of the hydrophobic fine silica powder and 1 g in the case of the toner particles and toner) and a carrier iron powder having main particle size in 200 to 300 meshes (e.g., EFV200/300, available from Nihon Teppun K.K.) (9.8 g in the case of measurement for the hydrophobic fine silica powder and 9 g in the case of measurement for the toner particles and toner) are left overnight in an environment of 23.5° C. and 60%RH, and are precisely weighed out in the above environment. These are put in a capped wide-mouthed bottle with a volume of about 50 cc, made of polyethylene, and the measuring sample and carrier iron powder are thoroughly mixed (manually shaked about 125 times up and down for about 50 seconds).

Figure 4:
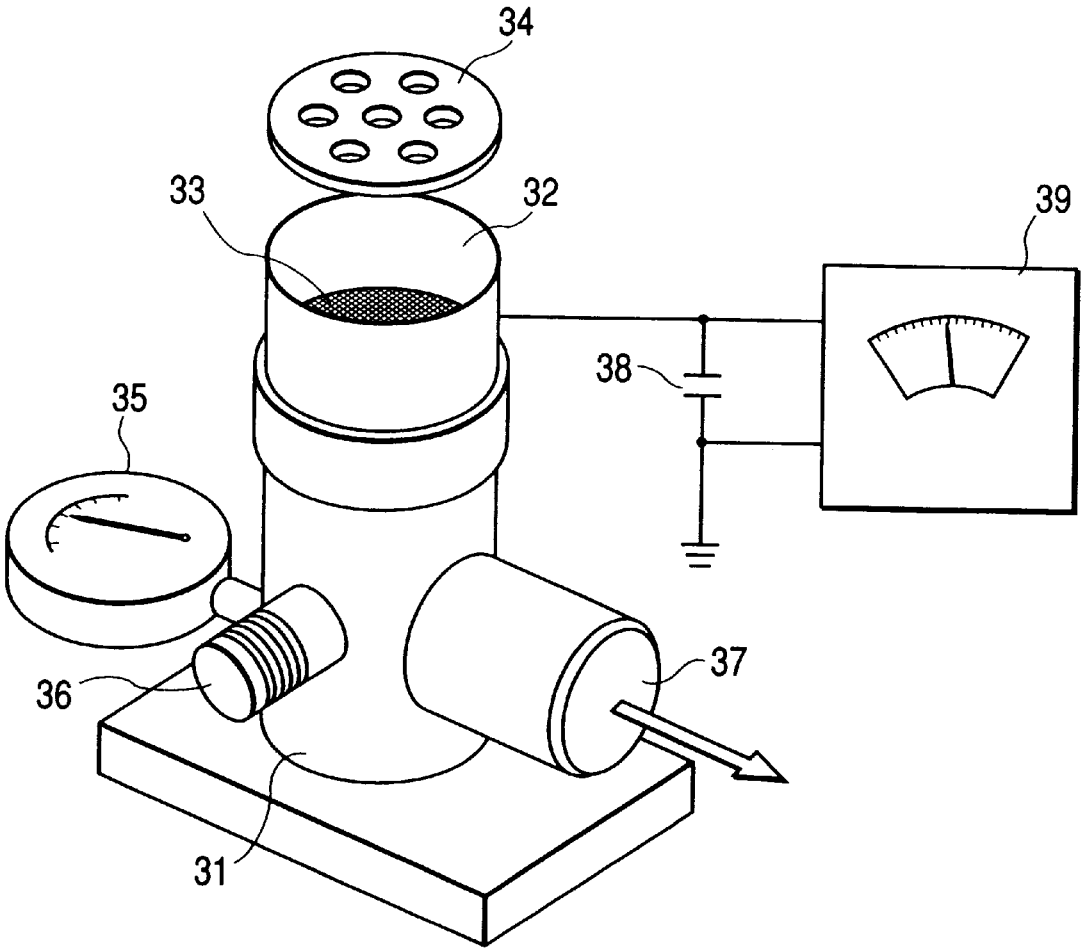
FIG. 4 is an illustration of a measuring device used to measure charge quantity.

Next, as shown in FIG. 4, about 2.0 g of the resulting mixture is put in a measuring container 32 made of a metal at the bottom of which a conductive screen 33 of 400 meshes is provided, and the container is covered with a plate 34 made of a metal. The total weight of the measuring container 32 at this time is weighed and is expressed as W1 (g). Next, in a suction device 31 (made of an insulating material at least at the part coming into contact with the measuring container 32), air is sucked from a suction opening 37 and an air-flow control valve 36 is operated to control the pressure indicated by a vacuum indicator 35 to be 250 mmHg. In this state, suction is carried out for 5 minutes to remove the sample by suction. The potential indicated by a potentiometer 39 at this time is expressed as V (volt). Herein, reference numeral 38 denotes a capacitor, whose capacitance is expressed as C (μF). The total weight of the measuring container after completion of the suction is also weighed and is expressed as W2 (g). The quantity of triboelectricity (μC/g) of the magnetic toner is calculated as shown by the following expression.

$$\text{Quantity of triboelectricity } (\mu C/g) = CV/(W1-W2)$$

The toner of the present invention is constituted of the hydrophobic fine silica powder having the characteristic hydrophobic properties described previously and toner particles. As the toner particles used in the present invention, toner particles constituted as commonly used are usable. Usually the toner particles comprise a colored resin composition having at least a binder resin and a colorant.

As the binder resin used in the present invention, it may include, e.g., polystyrene; homopolymers of styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural-resin-modified phenolic resins, natural-resin-modified maleic acid resins, acrylic resins, methacrylic resins, polyvinyl acetate, silicone resins, polyester resins, polyurethane, polyamide resins, furan resins, epoxy resins, xylene resins, polyvinyl butyral, terpene resins, cumarone indene resins, and petroleum resins, any of which may be used. A cross-linked styrene resin is a preferred binder resin.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; ethylenic olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination.

As cross-linking agents, compounds having at least two polymerizable double bonds may be used here, which may include aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups. Any of these may be used alone or in the form of a mixture.

As a binder resin for the toner used in pressure fixing, it may include low-molecular weight polyethylene, low-molecular weight polypropylene, an ethylene-viny acetate copolymer, an ethylene-acrylic ester copolymer, higher fatty acids, polyamide resins, and polyester resins. Any of these may be used alone or in the form of a mixture.

From the viewpoint of an improvement in releasability from a fixing member at the time of fixing and an improvement in fixing performance, it is also preferable to incorporate into toner particles any of the following waxes as a release agent: They are paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft-modified products.

As other additives, it is also possible to use alcohols, fatty acids, acid amides, esters, ketones, hardened castor oil and derivatives thereof, vegetable waxes, animal waxes, mineral waxes, and petrolatum.

In the toner of the present invention, an organic metal compound may preferably be used as a charge control agent. Among organic metal compounds, metal complexes containing as a ligand or counter ion an organic compound rich in volatility or sublimation properties are particularly useful.

Such metal complexes include azo type metal complexes represented by the following general formula.

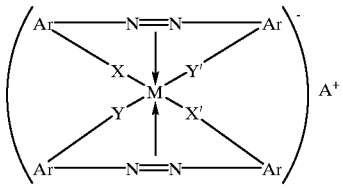

or

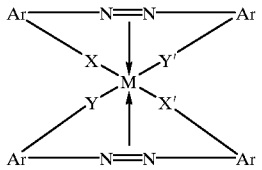

In the formulas, M represents a central metal of coordination, including metals having a coordination number of 6, as exemplified by Cr, Co, Ni, Mn, Fe, Al, Ti, Sc or V. Ar represents an aryl group such as a phenyl group or a naphthyl group, which may have a substituent. In such a case, the substituent includes a nitro group, a halogen group, a carboxyl group, an anilido group, and an alkyl group or alkoxyl group having 1 to 18 carbon atoms. X, X', Y and Y' each represent —O—, —CO—, —NH— or —NR— (R is an alkyl group having 1 to 4 carbon atoms). $A^+$ represents a hydrogen ion, a sodium ion, a potassium ion, an ammonium ion, an aliphatic ammonium ion, or a mixed ion of any of these.

Examples (a) to (c) of the azo type metal complexes represented by the above general formula are shown below as examples preferably usable in the present invention.

(a)

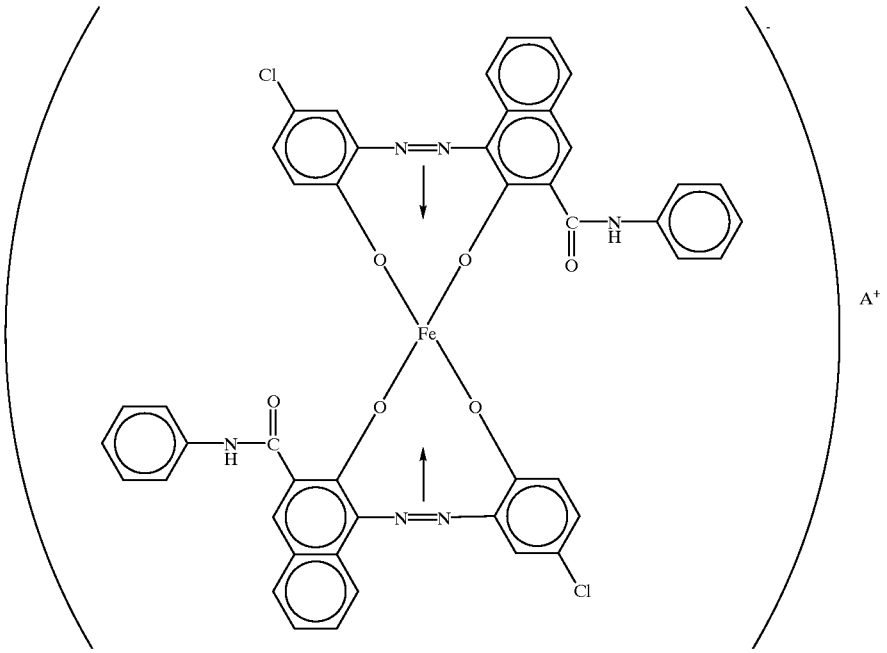

($A^+$: $H^+$, $Na^+$, $K^+$, $NH_4^+$, an aliphatic ammonium ion, or a mixed ion of any of these)

(b)

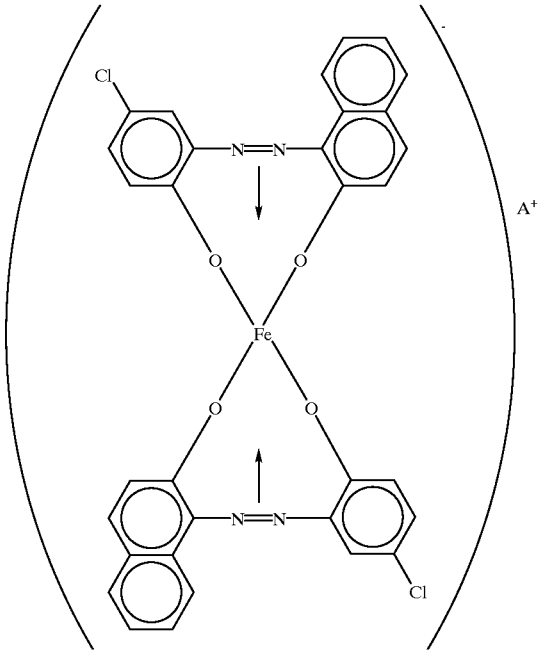

($A^+$: $H^+$, $Na^+$, $K^+$, $NH_4^+$, an aliphatic ammonium ion, or a mixed ion of any of these)

(c)

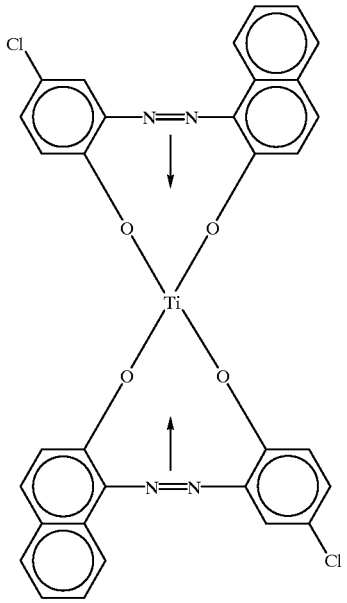

The toner of the present invention may be used as a magnetic toner containing a magnetic material as a colorant. Magnetic materials preferably usable in such a case may include magnetic metal oxides containing an element such as iron, cobalt, nickel, copper, magnesium, manganese, aluminum or silicon. In particular, those composed chiefly of an iron oxide such as triiron tetraoxide or γ-iron oxide are preferred.

From the viewpoint of an improvement in fluidity of toner and a charge controllability, the magnetic material may preferably contain a silicon atom. Especially when magnetic toner particles have a small particle diameter, the toner particles themselves have a low fluidity. Hence, only the addition of the hydrophobic fine silica powder used in the present invention, described previously, can not provide any sufficient fluidity and may make it impossible to achieve a good chargeability, to make it difficult to achieve the object of the present invention in some cases. The silicon atom may preferably be contained in an amount of from 0.2 to 2.0% by weight based on the weight of the magnetic material. If they are less than 0.2% by weight, no sufficient fluidity may be attained to cause difficulties such as poor character sharpness and solid-black density decrease. If they are contained in an amount more than 2.0% by weight, image density tends to decrease especially in an environment of high temperature and high humidity. The silicon atom may more preferably be contained in an amount of from 0.3 to 1.7% by weight. In particular, more preferred is a case where the silicon atom is present on the particle surfaces of the magnetic material in an amount of from 0.05 to 0.5% by weight.

The silicon atom may be added in the form of a water-soluble silicon compound when the magnetic material is formed, or may be added in the form of a silicon compound after the magnetic material has been formed, filtered and dried, and be made to fix to the particle surfaces by means of a mixing machine such as a mix muller. As particles of such magnetic material, it is preferable to use those having a BET specific surface area, as measured by nitrogen gas absorption, of from 2 to 30 $m^2/g$, and particularly from 3 to 28 $m^2/g$ It is also preferable to use magnetic particles having a Mohs hardness of from 5 to 7.

As the shape of such magnetic particles used, they may be octahedral, hexahedral, spherical, acicular or flaky. Octahedral, hexahedral, spherical or amorphous ones are preferred as having less anisotropy. In particular, in order to make image density higher, it is preferable for the magnetic particles to have a sphericity V of 0.8 or more. The magnetic particles may preferably have a number-average particle diameter of from 0.05 to 1.0 $\mu$m, more preferably from 0.1 to 0.6 $\mu$m, and particularly preferably of from 0.1 to 0.4 $\mu$m.

Such a magnetic material may be contained in the toner of the present invention in an amount of from 30 to 200 parts by weight, preferably from 60 to 200 parts by weight, and more preferably from 70 to 150 parts by weight, based on 100 parts by weight of the binder resin. If it is less than 30 parts by weight, the toner may have a poor transport performance to cause an uneven toner layer on the developer carrying member, tending to result in uneven images, and also tending to cause a decrease in image density that is ascribable to an increase in triboelectricity of the magnetic toner. If on the other hand the magnetic material is in a content more than 200 parts by weight, there is a possibility of a lowering of fixing performance.

In the present invention, the number-average i-particle diameter of the magnetic material is measured in the following way.

A photograph of magnetic particles constituting a magnetic fine powder is taken with a transmission electron microscope, and is magnified 40,000 times. On this photograph, 250 particles are picked up at random. Thereafter, in their projected diameters, Martin diameter (the length of a segment that divides the projected area in two halves in a given direction) is measured, and the number-average particle diameter is calculated on the basis of the measured values.

To produce the toner of the present invention, a known process may be used. For example, the toner particles can be produced by thoroughly mixing the binder resin, the wax, the metal salt or metal complex, a pigment, dye or magnetic material as a colorant, and optionally the charge control agent and other additives by means of a mixing machine such as a Henschel mixer or a ball mill, thereafter melt-kneading the mixture using a heat kneading machine such as a heat roll, a kneader or an extruder to make resins melt mutually and make the metal compound, pigment or dye and magnetic material dispersed or dissolved in the molten product, and solidifying the resulting dispersion or solution by cooling, followed by pulverization and classification. In the step of classification, a multi-division classifier may preferably be used in view of production efficiency to obtain toner particles having the desired particle size distribution.

In the toner of the present invention, the external additive comprising the hydrophobic fine silica powder having the characteristic hydrophobic properties described previously is added and mixed in an amount ranging approximately from 1 to 10 parts by weight based on 100 parts by weight the toner particles obtained in the above classification step. Apparatus preferably usable in such a mixing step of external addition may include Henschel mixers manufactured by Mitsui Miike Engineering Corporation, trade-named FM-500, FM-300, FM-75, FM-10 and so forth.

Figures 1, 2:
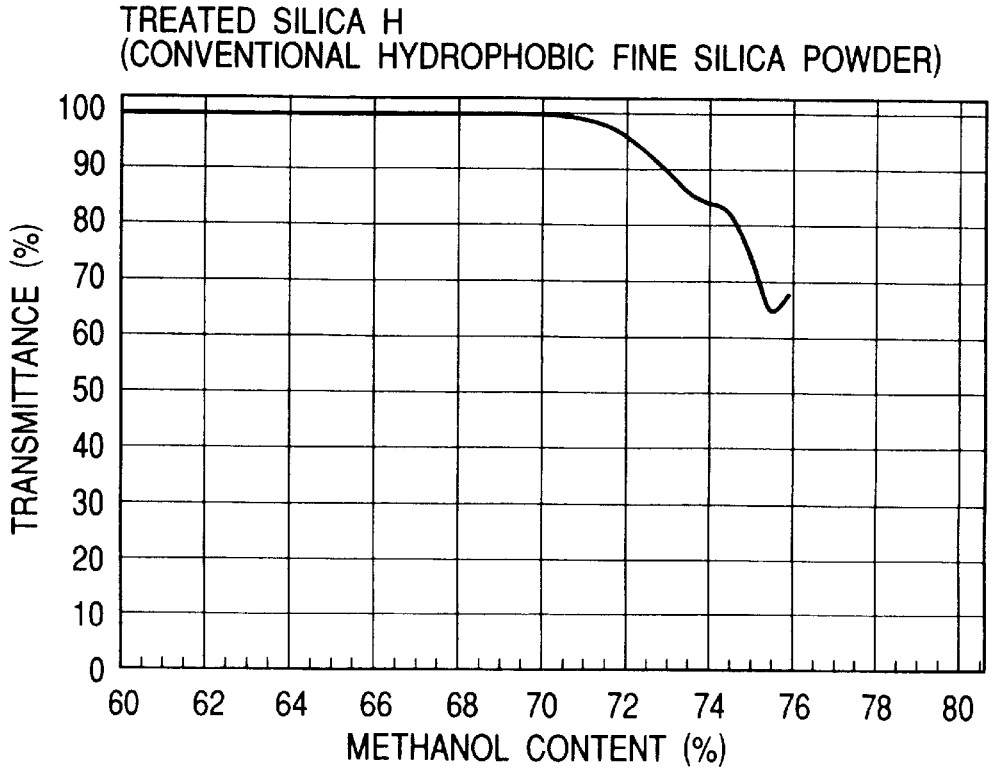
Figure 2:
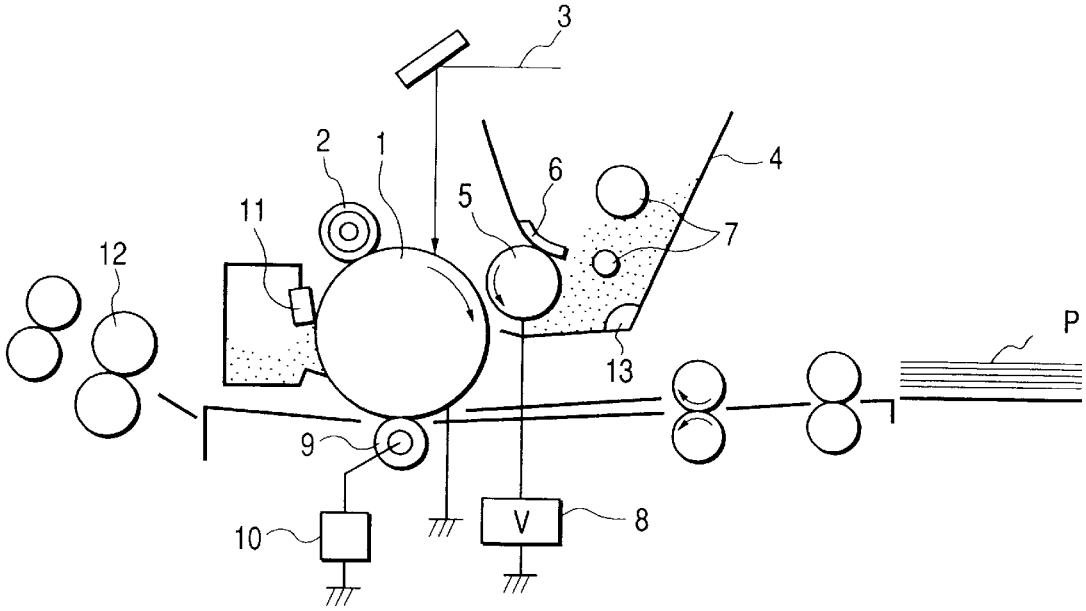

FIG. 2 schematically illustrates an example of an image forming apparatus in which the toner of the present invention, constituted as described above, is preferably usable. With reference to it, the image forming method of the present invention will be described below.

In FIG. 2, reference numeral 1 denotes a rotating-drum type electrostatic latent image bearing member, around which a charging roller (charging member) 2 as a primary charging assembly, an exposure optical system 3, a developing assembly 4 having a toner carrying member 5, a transfer roller (transfer assembly) 9 and a cleaning blade (cleaning assembly) 11 are disposed.

In this image forming apparatus, first the surface of the photosensitive member electrostatic latent image bearing member 1 is uniformly charged by means of the charging roller 2, and is exposed to light through the exposure optical system 3, so that an electrostatic latent image is formed on the surface of the electrostatic latent image bearing member.

Here, the charging member used in the image forming method of the present invention may have any shape without any particular limitations as long as it is a contact charging member disposed in contact with the electrostatic latent image bearing member. It may have any shape of a roller as shown in FIG. 2, a blade or a brush. Voltage applied to such a charging member may preferably be a DC voltage of from 200 to 2,000 V as an absolute value, and an AC voltage having a peak-to-peak voltage of from 400 to 4,000 V and a frequency of from 200 to 3,000 Hz.

Next, on the surface of the toner carrying member 5, internally provided with a magnet, a toner coat layer is formed by the toner of the present invention by the aid of a toner layer thickness regulation member 6, and is carried and transported to a developing zone. At the developing zone, the electrostatic latent image held on the electrostatic latent image bearing member 1 is developed while applying an alternating bias, a pulse bias and/or a DC bias across a conductive substrate of the electrostatic latent image bearing member 1 and the toner carrying member 5 through a bias applying means 8, thus a toner image is formed thereon.

The toner image formed by development is transferred electrostatically onto a transfer paper P upon application of electric charges having a polarity reverse to that of the toner, which are applied from the back of the transfer paper P through a transfer roller as the transfer assembly 9 and a voltage applying means 10. Then, the transfer paper P to which the toner image has been transferred is passed through a heat-and-pressure roller fixing assembly 12, thus a fixed image is obtained.

The toner remaining on the electrostatic latent image bearing member after the step of transfer is removed by the cleaning assembly cleaning blade 11 and collected in a cleaner 14, and the steps of primary charging and so on are again repeated.

Among constituents including the above electrostatic latent image bearing member (such as a photosensitive drum), the developing assembly and the cleaning means, a plurality of constituents may be integrally joined as an apparatus unit to set up a process cartridge so that the process cartridge is detachably mountable to the main body of an image forming apparatus. For example, the charging member and the developing assembly may be supported integrally together with the photosensitive drum to form the process cartridge so that it is detachably mountable as a single unit, to the main body of an image forming apparatus through a guide means such as a rail provided in the body of the apparatus. Here, the unit may be set up by also setting the cleaning means on the side of the process cartridge.

Figure 3:
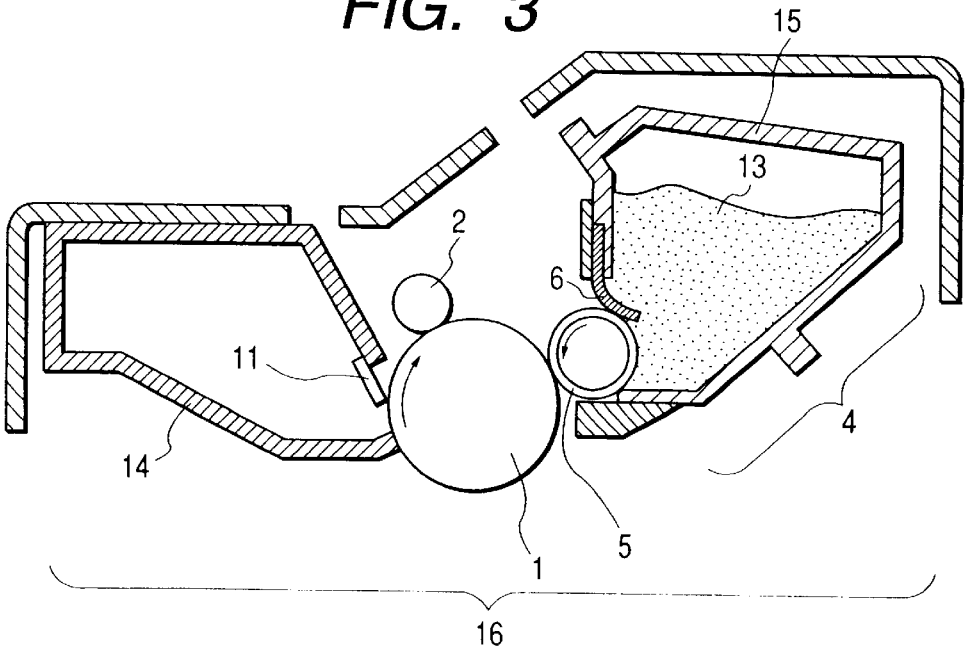
FIG. 3 is an illustration of an example of a process cartridge according to the present invention.

FIG. 3 shows an example of the process cartridge which is the apparatus unit of the present invention. In this example, a process cartridge 10 is exemplified which is integrally provided with a developing assembly 4, a drum type electrostatic latent image bearing member (photosensitive drum) 1, a cleaner 14 having a cleaning blade 11, and a primary charging member 2. In such a process cartridge, the whole cartridge is changed for a new process cartridge when a magnetic toner 13 of the developing assembly 4 is used up.

In the example shown in FIG. 3, the developing assembly 4 has the magnetic toner 13. A stated electric field is formed across the photosensitive drum 1 and a developing sleeve 5 serving as a toner carrying member. In order for the development to be performed preferably, the distance between the photosensitive drum 1 and the developing sleeve 5 is very important.

In the process cartridge shown in FIG. 3, the developing assembly 4 has i) a toner container 15 for holding the magnetic toner 13, ii) the developing sleeve 5 on which the magnetic toner 13 held in the toner container 15 is carried and transported from the toner container 15 to a developing zone where the sleeve faces the electrostatic latent image bearing member 1, and iii) an elastic blade 6 as a toner layer thickness regulation member with which the magnetic toner carried on the developing sleeve 5 and transported to the developing zone is regulated in a stated thickness to form a toner thin layer on the developing sleeve 5.

The developing sleeve 5 may have any desired structure. Usually it is constituted of a non-magnetic developing sleeve 5 internally provided with a magnet (not shown). The developing sleeve 5 may be a cylindrical rotating member as shown in the drawing. It may also be of a circulative belt type. As materials therefor, usually, aluminum and stainless steel may preferably be used.

The elastic blade 6 is constituted of an elastic plate formed of a rubber elastic material such as urethane rubber, silicone rubber or NBR; a metal elastic material such as phosphor bronze or stainless steel sheet; or a resin elastic material such as polyethylene terephthalate or high-density polyethylene. The elastic blade 6 comes into touch with the developing sleeve 5 by its own elasticity, and is fastened to the toner container 15 with a blade supporting means comprising a rigid body made of, e.g., iron. The elastic blade 6 may preferably come into touch with the developing sleeve 5 at a linear pressure of from 5 to 80 g/cm in the counter direction with respect to the direction of sleeve rotation. In place of such an elastic blade 6, a magnetic doctor blade made of, e.g., iron may also be used.

With regard to the primary charging means, in the previous description the charging roller 2 is used as the primary charging member. Alternatively, a contact charging means such as a charging blade or a charging brush may be used. The contact charging means is preferred in view of less ozone caused by charging. As the transfer means, the transfer roller is used in the above description. It may alternatively be a contact transfer means such as a transfer blade, or may also be a non-contact, corona transfer means. However, for this means, too, the contact transfer means is preferred in view of less ozone caused by transfer.

As described above, according to the present invention, a toner having superior properties can be provided because of the use of the toner containing the highly hydrophobic fine silica powder, which enables simultaneous prevention of drum melt-adhesion and smeared images even in an environment of high temperature and high humidity, can make the drum surface less abrade and also can improve transfer efficiency.

EXAMPLES

The present invention will be described below in greater detail by giving Examples, which, however, by no means limit the present invention. In the following, "part(s)" means part(s) by weight.

[1] Production of hydrophobic fine silica powder and physical properties thereof:

Hydrophobic Fine Silica Powder A 50 kg of base material silica (fine silica powder) having a specific surface area of 200 $m^2/g$ was put into a 2 $m^3$ reaction tank. Thereafter, the inside of the tank was displaced with nitrogen, and a given amount of pressurized water vapor controlled at 130° C. was introduced into the tank, and then the reaction tank was hermetically closed. In an atmosphere of this nitrogen, the reaction tank was set at an internal temperature of 250° C. and was hermetically closed, into which 8 kg of hexamethyldisilazane was introduced to carry out reaction for 80 minutes. The inside of the reaction tank was displaced with nitrogen to remove the unreacted hexamethyldisilazane. During this reaction, the molar ratio of water vapor to hexamethyldisilazane was 0.6. From a treating agent feed pipe kept at a temperature of 100° C., 5 kg of dimethylsilicone oil having a viscosity at 25° C. of 100 centistokes was sprayed in the state of a stock solution without being diluted, to make hydrophobic treatment, followed by heating at 250° C. for 30 minutes to obtain hydrophobic fine silica powder A.

Physical properties of the hydrophobic fine silica powder A thus obtained are shown in Table 1. The transmittance of its measuring sample fluid is shown in Table 2.

Hydrophobic Fine Silica Powder B

Hydrophobic fine silica powder B was obtained in the same manner as the hydrophobic fine silica powder A except that the amount of the dimethylsilicone oil fed from the treating agent feed pipe was so changed that the treatment with dimethylsilicone oil was in an amount of 15 parts based on 100 parts of the base material silica.

Physical properties of the hydrophobic fine silica powder B and the transmittance of its measuring sample fluid are shown in Tables 1 and 2, respectively.

Hydrophobic Fine Silica Powder C

Hydrophobic fine silica powder C was obtained in the same manner as the hydrophobic fine silica powder A except that the amount of the silicone oil fed from the treating agent feed pipe was so changed that the treatment with dimethylsilicone oil was in an amount of 40 parts based on 100 parts of the base material silica.

Physical properties of the hydrophobic fine silica powder C and the transmittance of its measuring sample fluid are shown in Tables 1 and 2, respectively.

Hydrophobic Fine Silica Powder D

Hydrophobic fine silica powder D was obtained in the same manner as the hydrophobic fine silica powder A except that the amount of the dimethylsilicone oil fed from the treating agent feed pipe was so changed that the treatment with dimethylsilicone oil was in an amount of 5 parts based on 100 parts of the base material silica.

Physical properties of the hydrophobic fine silica powder D and the transmittance of its measuring sample fluid are shown in Tables 1 and 2, respectively.

Hydrophobic Fine Silica Powder E

Hydrophobic fine silica powder E was obtained in the same manner as the hydrophobic fine silica powder A except that the amount of the hexamethyldisilazane fed from a treating agent feed pipe was so changed that the treatment with hexamethyldisilazane was in an amount of 24 parts based on 100 parts of the base material silica.

Physical properties of the hydrophobic fine silica powder E and the transmittance of its measuring sample fluid are shown in Tables 1 and 2, respectively.

Hydrophobic Fine Silica Powder F

Hydrophobic fine silica powder F was obtained in the same manner as the hydrophobic fine silica powder A except that the amount of the hexamethyldisilazane fed from a treating agent feed pipe was so changed that the treatment with hexamethyldisilazane was in an amount of 32 parts based on 100 parts of the base material silica.

Physical properties of the hydrophobic fine silica powder F and the transmittance of its measuring sample fluid are shown in Tables 1 and 2, respectively.

Hydrophobic Fine Silica Powder G

Hydrophobic fine silica powder G was obtained in the same manner as the hydrophobic fine silica powder E except that the base material silica having a specific surface area of 200 $m^2/g$ was replaced with base material silica having a specific surface area of 300 $m^2/g$.

Physical properties of the hydrophobic fine silica powder G and the transmittance of its measuring sample fluid are shown in Tables 1 and 2, respectively.

Hydrophobic Fine Silica Powder H

Hydrophobic fine silica powder H was obtained in the same manner as the hydrophobic fine silica powder A except the following: The molar ratio of water vapor was changed to 0.1 to make the treatment with hexamethyldisilazane. When the fine silica powder having been treated with hexamethyldisilazane was treated with dimethylsilicone oil, the stock solution dimethylsilicone oil was replaced with a dilute solution prepared by diluting dimethylsilicone oil having a viscosity at 25° C. of 100 centistokes with n-hexane by dissolving the former in the latter, and the dilute solution was sprayed while feeding it into the reaction tank from a treating agent feed pipe not temperature-controlled, to make hydrophobic treatment, followed by heating at 350° C. for 20 minutes to obtain hydrophobic fine silica powder H.

Physical properties of the hydrophobic fine silica powder H and the transmittance of its measuring sample fluid are shown in Tables 1 and 2, respectively.

Hydrophobic Fine Silica Powder I

Hydrophobic fine silica powder I was obtained in the same manner as the hydrophobic fine silica powder A except that the fine silica powder having been treated with hexamethyldisilazane was not treated with dimethylsilicone oil.

Physical properties of the hydrophobic fine silica powder I and the transmittance of its measuring sample fluid are shown in Tables 1 and 2, respectively.

Hydrophobic Fine Silica Powder J

Hydrophobic fine silica powder J was obtained in the same manner as the hydrophobic fine silica powder A except that the pressurized water vapor was not introduced into the tank when the base material silica was treated with hexamethyldisilazane, and only the hexamethyldisilazane was fed into a mixer to make hydrophobic treatment.

Physical properties of the hydrophobic fine silica powder J and the transmittance of its measuring sample fluid are shown in Tables 1 and 2, respectively.

Hydrophobic Fine Silica Powder K

Hydrophobic fine silica powder K was obtained in the same manner as the hydrophobic fine silica powder A except that the pressurized water vapor was not introduced into the tank when the base material silica was treated with hexamethyldisilazane, only the hexamethyldisilazane was fed into a mixer to make hydrophobic treatment, and, from a treating agent feed pipe not temperature-controlled, the dimethylsilicone oil was sprayed in the state of a stock solution without being diluted, to make hydrophobic treatment.

Physical properties of the hydrophobic fine silica powder K thus obtained are shown in Table 1. The transmittance of its measuring sample fluid is shown in Table 2.

Hydrophobic Fine Silica Powder L

Commercially available hydrophobic silica R-972, available from Nippon Aerosil Co., Ltd., was used.

Hydrophobic Fine Silica Powder M

Commercially available hydrophobic silica H-2000, available from Wacker Chemical Corp., was used.

TABLE 1

Production Conditions and Physical Properties of Hydrophobic Fine Silica Powder

| | Hydrophobic treatment | | | | | | | Hydrophobic fine silica powder physical properties | | |
|---|---|---|---|---|---|---|---|---|---|---|
| | Treatment with silane coupling agent | | | Treatment with silicone oil | | | | | | |
| Treated Silica: | * Amount of treatment (pbw) | Presence of water vapor | Treatment temp. (° C.) | * Amount of treatment (pbw) | Dilution with solvent | Heating temp. (° C.) | Heating | Carbon content (wt. %) | Specific surface area ($m^2/g$) | Charge quantity ($\mu C/g$) |
| A | 16 | Yes | 250 | 10 | No | 250 | Yes | 5.0 | 110 | −101 |
| B | 16 | Yes | 250 | 15 | No | 250 | Yes | 6.2 | 103 | −110 |
| C | 16 | Yes | 250 | 40 | No | 250 | Yes | 12.5 | 90 | −132 |
| D | 16 | Yes | 250 | 5 | No | 250 | Yes | 3.9 | 115 | −95 |
| E | 24 | Yes | 250 | 10 | No | 250 | Yes | 5.1 | 108 | −103 |
| F | 32 | Yes | 250 | 10 | No | 250 | Yes | 5.2 | 107 | −104 |
| G | 24 | Yes | 250 | 10 | No | 250 | Yes | 6.4 | 140 | −150 |
| H | 16 | Yes | 250 | 10 | Yes | 350 | Yes | 5.0 | 111 | −88 |
| I | 16 | Yes | 250 | — | — | — | — | 2.7 | 125 | −85 |
| J | 16 | No | 250 | 10 | No | 250 | Yes | 4.8 | 109 | −95 |
| K | 16 | No | 250 | 10 | No | 250 | No | 4.7 | 112 | −90 |
| L | R-972, available from Nippon Aerosil Co., Ltd. | | | | | | | 2.5 | 120 | −70 |
| M | H-2,000, available from Wacker Chemical Corp. | | | | | | | 2.8 | 115 | −85 |

*Amount based on 100 parts by weight of the base material silica

TABLE 2

Values of Transmittance (%) with Respect to Methanol Content (% by volume), Read from Methanol-dropping Transmittance Curve

| | Methanol content (% by volume) in measuring sample fluid | | | | | | | | | | | | | |
|---|---|---|---|---|---|---|---|---|---|---|---|---|---|---|
| | 60 | 70 | 71 | 72 | 73 | 74 | 75 | 76 | 77 | 78 | 79 | 80 | 81 | 82 |
| Silica A | >98 | >98 | 98 | 97 | 95 | 93 | 88 | 80 | 65* | — | — | — | — | — |
| Silica B | >98 | >98 | >98 | 98 | 96 | 95 | 90 | 87 | 65*(at 77.5) | | | | | — |
| Silica C | >98 | >98 | >98 | >98 | 98 | 95 | 92 | 90 | 85 | 65* | — | — | — | — |
| Silica D | >98 | >98 | 98 | 97 | 95 | 92 | 80 | 65* | — | — | — | — | — | — |
| Silica E | >98 | >98 | >98 | >98 | 98 | 97 | 96 | 95 | 92 | 65* | — | — | — | — |
| Silica F | >98 | >98 | >98 | >98 | >98 | >98 | >98 | >98 | 98 | 93 | 88 | 83 | 67*(at 80.5) | |
| Silica G | >98 | >98 | >98 | >98 | 98 | 97 | 92 | 80 | 55* | — | — | — | — | — |
| Silica H | >98 | >98 | 98 | 96 | 90 | 83 | 75 | 65*(at 75.5) | | | | — | — | — |
| Silica D | >98 | >98 | 98 | 94 | 89 | 82 | 65* | — | — | — | — | — | — | — |
| Silica J | >98 | >98 | 98 | 95 | 90 | 83 | 72* | 67* | — | — | — | — | — | — |
| Silica K | >98 | >98 | 96 | 91 | 86 | 80 | 65* | — | — | — | — | — | — | — |
| Silica L (R-972) | (reaches the end point at methanol content of 40% by volume) | | | | | | | | | | | | | |
| Silica M (H-2,000) | 95 | (reaches the end point at methanol content of 63% by volume) | | | | | | | | | | | | |

*End point of the titration

[2] Production of toners and evaluation results:

Example 1

| | |
|---|---|
| Binder resin (a styrene resin) | 100 parts |
| Magnetic material ($Fe_3O_4$) | 90 parts |
| Charge control agent (a monoazo iron complex) | 2 parts |
| Wax (polypropylene) | 3 parts |

A mixture of the above was melt-kneaded with a twin-screw extruder heated to 130° C., followed by cooling to obtain a kneaded product, which was then crushed with a hammer mill. The crushed product obtained was finely pulverized by means of a jet mill, followed by further classification by means of an Elbow Jet classifier to obtain toner particles having a weight-average particle diameter of 6.8 $\mu$m.

To the above toner particles, hydrophobic fine silica powder A having a specific surface area of 110 $m^2/g$ was added, followed by mixing using a Henschel mixer to obtain toner 1 having physical properties shown in Table 3.

Using an image forming apparatus constructed as shown in FIG. 2 to which apparatus the process cartridge shown in Table 3 was mounted, evaluation was made by the following image evaluation methods. Here, LJ-6L, manufactured by Hewllet Packard Co. was used as the process cartridge. Then, the toner 1 of the present Example, obtained as described above, was loaded in this process cartridge LJ-6L to form images. Results obtained are shown in Table 3.

The above LJ-6L employs as a primary charging member a contact charging roller coming into contact with the photosensitive member surface. To this charging roller, a charging voltage formed of DC voltage of −625 V and AC voltage of 1.8 kV in peak-to-peak voltage and 370 Hz in frequency is applied to charge the photosensitive member primarily. To its transfer roller, a voltage of 2.3 kV is applied to carry out transfer.

(1) Evaluation on drum melt-adhesion:

An image having an image area percentage of about 3% was continuously printed out on 2,500 sheets in an environment of high temperature and high humidity (33.0° C., 95%RH). Thereafter, a solid black image was formed on an A4-size recording paper over the whole area to make evaluation on the extent to which white spots appear in the solid black image. The evaluation was made according to the following ranks.

A: No white spot appears at all on the A4-size recording paper.
B: On the level intermediate between A and C.
C: About 10 white spots are seen on the A4-size recording paper.
D: On the level intermediate between C and E.
E: At least 100 white spots are seen on the A4-size recording paper.

(2) Smeared images:

An image having an image area percentage of about 3% was continuously printed out on 2,500 sheets in an environment of high temperature and high humidity (33.0° C., 95%RH). Thereafter, evaluation was made on the extent of smeared images after the 2,500-sheet printing. In this evaluation, sheets of paper (made to have a moisture absorption of 10% in the environment of 33.0° C./95%RH) containing talc as a filler, tending to cause smeared images, were used as evaluation paper. Incidentally, the moisture absorption of paper was measured with MOISTREX MX5000, manufactured by Infrared Engineering Co. The evaluation was made according to the following ranks.

A: No smeared images appear at all.
B: On the level intermediate between A and C.
C: Smeared images appear but characters are legible.
D: On the level intermediate between C and E.
E: Smeared images appear and characters are illegible.

(3) Drum abrasion:

An image having an image area percentage of about 3% was continuously printed out on 3,000 sheets in an environment of low temperature and low humidity (15.0° C., 10%RH). Thereafter, the amount of abrasion of the drum surface was measured, and a value calculated as a value for 1,000 sheets was used. It was measured with a layer thickness measuring instrument manufactured by Fischer Co.

(4) Transfer efficiency:

In an environment of normal temperature and normal humidity (25.0° C., 60%RH), transfer efficiency was examined from solid black images formed on the drum surface. The value of transfer efficiency is a value obtained by dividing the quantity per unit area of the toner present on the transfer paper after transfer by a value obtained by adding the quantity per unit area of the toner having remained on the drum surface after transfer to the quantity per unit area of the toner present on the transfer paper after transfer.

Example 2

A toner of the present Example, having physical properties shown in Table 3, was obtained in the same manner as in Example 1 except that the magnetic material was incorporated in an amount of 100 parts and toner particles having a weight-average particle diameter of 5.8 μm were produced and used. The toner obtained was evaluated in the same manner as in Example 1 to obtain the results shown in Table 3.

Example 3

A toner of the present Example, having physical properties shown in Table 3, was obtained in the same manner as in Example 2 except that, in addition to the hydrophobic fine silica powder A, an external additive strontium titanate having as primary particles a number-average particle diameter of 1.8 μm was further used as the second inorganic fine powder in an amount of 0.6 part based on 100 parts of the toner particles. The toner obtained was evaluated in the same manner as in Example 1 to obtain the results shown in Table 3.

Examples 4 to 9

Toners of the present Examples, having physical properties shown in Table 3, were obtained in the same manner as in Example 3 except that the hydrophobic fine silica powders B to G, respectively, were each used as the hydrophobic fine silica powder to be used. The toners obtained were evaluated in the same manner as in Example 1 to obtain the results shown in Table 3.

Comparative Example 1

A toner of the present Comparative Example, having physical properties shown in Table 3, was obtained in the same manner as in Example 1 except for using the hydrophobic fine silica powder H, not having the characteristic hydrophobic properties specified in the present invention. The toner obtained was evaluated in the same manner as in Example 1 to obtain the results shown in Table 3.

Comparative Example 2

A toner of the present Comparative Example, having physical properties shown in Table 3, was obtained in the same manner as in Comparative Example 1 except that, in addition to the hydrophobic fine silica powder H, the strontium titanate as used in Example 3 was further added in an amount of 0.6 part based on 100 parts of the toner particles. The toner obtained was evaluated in the same manner as in Example 1 to obtain the results shown in Table 3.

Comparative Examples 3 to 7

Toners of the present Comparative Examples, having physical properties shown in Table 3, were obtained in the same manner as in Example 1 except for using the hydrophobic fine silica powders I to M, respectively, not having the characteristic hydrophobic properties specified in the present invention. The toners obtained were evaluated in the same manner as in Example 1 to obtain the results shown in Table 3.

TABLE 3

| | External additive | | Evaluation Results: Toner particles | | Evaluation Results: Toner | | Evaluation results | | | |
|---|---|---|---|---|---|---|---|---|---|---|
| | Hydrophobic silica | Second inorganic fine powder | Weight = average particle diameter (μm) | Charge quantity (μC/g) | Weight = average particle diameter (μm) | Charge polarity | Melt adhesion | smeared images | Drum abrasion (μm/k) | Transfer efficiency (%) |
| Example: | | | | | | | | | | |
| 1 | A | None | 6.8 | −10.0 | 6.8 | negative | B | D | 2.00 | 87 |
| 2 | A | None | 5.8 | −12.5 | 5.8 | negative | C | C | 2.05 | 89 |
| 3 | A | S.T.* | 5.8 | −12.5 | 5.8 | negative | C | B | 2.25 | 89 |
| 4 | B | S.T.* | 5.8 | −12.5 | 5.8 | negative | B | C | 2.05 | 90 |
| 5 | C | S.T.* | 5.8 | −12.5 | 5.8 | negative | A | D | 1.95 | 92 |
| 6 | D | S.T.* | 5.8 | −12.5 | 5.8 | negative | C | B | 2.30 | 88 |
| 7 | E | S.T.* | 5.8 | −12.5 | 5.8 | negative | A | A | 1.95 | 91 |
| 8 | F | S.T.* | 5.8 | −12.5 | 5.8 | negative | A | A | 1.92 | 92 |
| 9 | G | S.T.* | 5.8 | −12.5 | 5.8 | negative | B | A | 2.05 | 92 |
| Comparative Example: | | | | | | | | | | |
| 1 | H | None | 6.8 | −10.0 | 6.8 | negative | C | E | 2.15 | 84 |
| 2 | H | S.T.* | 6.8 | −10.0 | 6.8 | negative | D | C | 2.45 | 85 |
| 3 | I | None | 6.8 | −10.0 | 6.8 | negative | E | D | 2.40 | 82 |
| 4 | J | None | 6.8 | −10.0 | 6.8 | negative | D | E | 2.15 | 85 |
| 5 | K | None | 6.8 | −10.0 | 6.8 | negative | D | E | 2.11 | 85 |
| 6 | L (R-972) | None | 6.8 | −10.0 | 6.8 | negative | E | E | 2.25 | 82 |
| 7 | M (H-2,000) | None | 6.8 | −10.0 | 6.8 | negative | E | E | 2.20 | 84 |

*S.T.: Strontium titanate

What is claimed is:

1. A toner comprising toner particles and a hydrophobic fine silica powder, wherein;

said hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of said measuring sample fluid at a methanol content of from 60% by volume to 72% by volume is 95% or more; and (ii) the transmittance of said measuring sample fluid at a methanol content of 74% by volume is 90% or more.

2. The toner according to claim 1, wherein the transmittance of said measuring sample fluid at a methanol content of 75% by volume is 90% or more.

3. The toner according to claim 1, wherein the transmittance of said measuring sample fluid at a methanol content of 76% by volume is 85% or more.

4. The toner according to claim 1, wherein said hydrophobic fine silica powder has a carbon content of from 4.5% by weight to 12.0% by weight.

5. The toner according to claim 1, wherein said hydrophobic fine silica powder has been treated with an organosilicon compound.

6. The toner according to claim 1, wherein said hydrophobic fine silica powder has been treated with a silicone oil.

7. The toner according to claim 1, wherein said hydrophobic fine silica powder is a powder having been treated with a silicone oil and thereafter having been subjected to heat treatment at 200° C. or above.

8. The toner according to claim 1, wherein said hydrophobic fine silica powder is a powder having been treated with a silane coupling agent and a silicone oil or silicone varnish.

9. The toner according to claim 1, wherein said hydrophobic fine silica powder is a powder having been treated with a silane coupling agent in the presence of water vapor, and thereafter having been subjected to hydrophobic treatment by spraying a silicone oil or silicone varnish having a viscosity at 25° C. of from 10 centistokes to 2,000 centistokes while being heated at a temperature of from 50° C. to 200° C.

10. The toner according to claim 1, which has a weight-average particle diameter of from 3.5 μm to 9.9 μm.

11. The toner according to claim 1, which has a weight-average particle diameter of from 3.5 μm to 6.5 μm.

12. The toner according to claim 1, wherein said hydrophobic fine silica powder has externally been added in an amount of from 0.6 part by weight to 3.0 parts by weight based on 100 parts by weight of said toner particles.

13. The toner according to claim 1, wherein said hydrophobic fine silica powder has a number-average particle diameter of 0.1 μm or smaller as primary particles.

14. The toner according to claim 1, wherein said hydrophobic fine silica powder has a number-average particle diameter of from 5 nm to 50 nm as primary particles.

15. The toner according to claim 1, wherein said hydrophobic fine silica powder has a BET specific surface area of from 10 $m^2/g$ to 550 $m^2/g$ as measured by nitrogen gas adsorption.

16. The toner according to claim 1, wherein a second inorganic fine powder other than said hydrophobic fine silica powder has externally been added to said toner particles.

17. The toner according to claim 16, wherein said second inorganic fine powder has a number-average particle diameter of from 0.12 μm to 3.0 μm as primary particles.

18. The toner according to claim 16, wherein said second inorganic fine powder is a composite oxide.

19. The toner according to claim 16, wherein said second inorganic fine powder is fine strontium titanate powder, fin e calcium titanate powder or fine silicon titanate powder.

20. The toner according to claim 1, wherein said toner particles are negatively chargeable toner particles.

21. The toner according to claim 20, wherein said toner particles have a negative triboelectric chargeability to iron powder of from −2.0 μC/g to −50 μC/g.

22. The toner according to claim 1, wherein said hydrophobic fine silica powder is a negatively chargeable hydrophobic fine silica powder.

23. The toner according to claim 22, wherein said hydrophobic fine silica powder has a negative triboelectric chargeability to iron powder of from −50 μC/g to −300 μC/g.

24. An image forming method comprising the steps of:

forming an electrostatic latent image on an electrostatic latent image bearing member;

developing the electrostatic latent image by a developing means having a toner, to form a toner image;

transferring the toner image held on the electrostatic latent image bearing member, to a transfer material via, or not via, an intermediate transfer member; and fixing by a fixing means the toner image held on the transfer material;

said toner comprising toner particles and a hydrophobic fine silica powder, wherein;

said hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of said measuring sample fluid at a methanol content of from 60% by volume to 72% by volume is 95% or more; and (ii) the transmittance of said measuring sample solution at a methanol content of 74% by volume is 90% or more.

25. The method according to claim 24, wherein the transmittance of said measuring sample fluid at a methanol content of 75% by volume is 90% or more.

26. The method according to claim 24, wherein the transmittance of said measuring sample fluid at a methanol content of 76% by volume is 85% or more.

27. The method according to claim 24, wherein said hydrophobic fine silica powder has a carbon content of from 4.5% by weight to 12.0% by weight.

28. The method according to claim 24, wherein said hydrophobic fine silica powder has been treated with an organosilicon compound.

29. The method according to claim 24, wherein said hydrophobic fine silica powder has been treated with a silicone oil.

30. The method according to claim 24, wherein said hydrophobic fine silica powder is a powder having been treated with a silicone oil and thereafter having been subjected to heat treatment at 200° C. or above.

31. The method according to claim 24, wherein said hydrophobic fine silica powder is a powder having been treated with a silane coupling agent and a silicone oil or silicone varnish.

32. The method according to claim 24, wherein said hydrophobic fine silica powder is a powder having been treated with a silane coupling agent in the presence of water vapor, and thereafter having been subjected to hydrophobic treatment by spraying a silicone oil or silicone varnish having a viscosity at 25° C. of from 10 centistokes to 2,000 centistokes while being heated at a temperature of from 50° C. to 200° C.

33. The method according to claim 24, wherein said toner has a weight-average particle diameter of from 3.5 μm to 9.9 μm.

34. The method according to claim 24, wherein said toner has a weight-average particle diameter of from 3.5 μm to 6.5 μm.

35. The method according to claim 24, wherein said hydrophobic fine silica powder has externally been added in an amount of from 0.6 part by weight to 3.0 parts by weight based on 100 parts by weight of said toner particles.

36. The method according to claim 24, wherein said hydrophobic fine silica powder has a number-average particle diameter of 0.1 μm or smaller as primary particles.

37. The method according to claim 24, wherein said hydrophobic fine silica powder has a number-average particle diameter of from 5 nm to 50 nm as primary particles.

38. The method according to claim 24, wherein said hydrophobic fine silica powder has a BET specific surface area of from 10 $m^2/g$ to 550 $m^2/g$ as measured by nitrogen gas adsorption.

39. The method according to claim 24, wherein a second inorganic fine powder other than said hydrophobic fine silica powder has externally been added to said toner particles.

40. The method according to claim 39, wherein said second inorganic fine powder has a number-average particle diameter of from 0.12 μm to 3.0 μm as primary particles.

41. The method according to claim 39, wherein said second inorganic fine powder is a composite oxide.

42. The method according to claim 39, wherein said second inorganic fine powder is fine strontium titanate powder, fine calcium titanate powder or fine silicon titanate powder.

43. The method according to claim 24, wherein said toner particles are negatively chargeable toner particles.

44. The method according to claim 43, wherein said toner particles have a negative triboelectric chargeability to iron powder of from −2.0 μC/g to −50 μC/g.

45. The method according to claim 24, wherein said hydrophobic fine silica powder is a negatively chargeable hydrophobic fine silica powder.

46. The method according to claim 45, wherein said hydrophobic fine silica powder has a negative triboelectric chargeability to iron powder of from −50 μC/g to −300 μC/g.

47. The method according to claim 24, wherein said electrostatic latent image bearing member is a photosensitive drum, and, in the step of forming an electrostatic latent image, a contact charging means is brought into contact with the photosensitive drum surface to charge the photosensitive drum primarily and the electrostatic latent image is formed on the primarily charged photosensitive drum upon exposure to light.

48. The method according to claim 47, wherein said contact charging means comprises a charging roller.

49. The method according to claim 24, wherein after the step of transfer a cleaning means is brought into contact with the electrostatic latent image bearing member surface to clean the surface of said electrostatic latent image bearing member.

50. The method according to claim 49, wherein said cleaning means comprises a cleaning blade.

51. An apparatus unit detachably mountable on a main assembly of an image forming apparatus; the unit comprising;

an electrostatic latent image bearing member for holding thereon an electrostatic latent image; and a developing means having a toner for developing the electrostatic latent image to form a toner image;

said toner comprising toner particles and a hydrophobic fine silica powder, wherein;

said hydrophobic fine silica powder has the following hydrophobic properties (i) and (ii) when hydrophobic properties possessed by the hydrophobic fine silica powder are represented by using a methanol-dropping transmittance curve prepared by measuring transmittance using light of 780 nm in wavelength while adding methanol dropwise at a rate of 1.3 ml/min. to a measuring sample fluid prepared by adding the hydrophobic fine silica powder precisely in an amount of 0.06 g in a container holding 70 ml of an aqueous methanol solution composed of 60% by volume of methanol and 40% by volume of water;

(i) the transmittance of said measuring sample fluid at a methanol content of from 60% by volume to 72% by volume is 95% or more; and (ii) the transmittance of said measuring sample fluid at a methanol content of 74% by volume is 90% or more.

52. The apparatus unit according to claim 51, wherein the transmittance of said measuring sample fluid at a methanol content of 75% by volume is 90% or more.

53. The apparatus unit according to claim 51, wherein the transmittance of said measuring sample fluid at a methanol content of 76% by volume is 85% or more.

54. The apparatus unit according to claim 51, wherein said hydrophobic fine silica powder has a carbon content of from 4.5% by weight to 12.0% by weight.

55. The apparatus unit according to claim 51, wherein said hydrophobic fine silica powder has been treated with an organosilicon compound.

56. The apparatus unit according to claim 51, wherein said hydrophobic fine silica powder has been treated with a silicone oil.

57. The apparatus unit according to claim 51, wherein said hydrophobic fine silica powder is a powder having been treated with a silicone oil and thereafter having been subjected to heat treatment at 200° C. or above.

58. The apparatus unit according to claim 51, wherein said hydrophobic fine silica powder is a powder having been treated with a silane coupling agent and a silicone oil or silicone varnish.

59. The apparatus unit according to claim 51, wherein said hydrophobic fine silica powder is a powder having been treated with a silane coupling agent in the presence of water vapor, and thereafter having been subjected to hydrophobic treatment by spraying a silicone oil or silicone varnish having a viscosity at 25° C. of from 10 centistokes to 2,000 centistokes while being heated at a temperature of from 50° C. to 200° C.

60. The apparatus unit according to claim 51, wherein said toner has a weight-average particle diameter of from 3.5 $\mu$m to 9.9 $\mu$m.

61. The apparatus unit according to claim 51, wherein said toner has a weight-average particle diameter of from 3.5 $\mu$m to 6.5 $\mu$m.

62. The apparatus unit according to claim 51, wherein said hydrophobic fine silica powder has externally been added in an amount of from 0.6 part by weight to 3.0 parts by weight based on 100 parts by weight of said toner particles.

63. The apparatus unit according to claim 51, wherein said hydrophobic fine silica powder has a number-average particle diameter of 0.1 $\mu$m or smaller as primary particles.

64. The apparatus unit according to claim 51, wherein said hydrophobic fine silica powder has a number-average particle diameter of from 5 nm to 50 nm as primary particles.

65. The apparatus unit according to claim 51, wherein said hydrophobic fine silica powder has a BET specific surface area of from 10 $m^2/g$ to 550 $m^2/g$ as measured by nitrogen gas adsorption.

66. The apparatus unit according to claim 51, wherein a second inorganic fine powder other than said hydrophobic fine silica powder has externally been added to said toner particles.

67. The apparatus unit according to claim 66, wherein said second inorganic fine powder has a number-average particle diameter of from 0.12 $\mu$m to 3.0 $\mu$m as primary particles.

68. The apparatus unit according to claim 66, wherein said second inorganic fine powder is a composite oxide.

69. The apparatus unit according to claim 66, wherein said second inorganic fine powder is fine strontium titanate powder, fine calcium titanate powder or fine silicon titanate powder.

70. The apparatus unit according to claim 51, wherein said toner particles are negatively chargeable toner particles.

71. The apparatus unit according to claim 70, wherein said toner particles have a negative triboelectric chargeability to iron powder of from −2.0 $\mu$C/g to −50 $\mu$C/g.

72. The apparatus unit according to claim 51, wherein said hydrophobic fine silica powder is a negatively chargeable hydrophobic fine silica powder.

73. The apparatus unit according to claim 72, wherein said hydrophobic fine silica powder has a negative triboelectric chargeability to iron powder of from −50 $\mu$C/g to −300 $\mu$C/g.

74. The apparatus unit according to claim 51, wherein said electrostatic latent image bearing member is a photosensitive drum, and which apparatus unit further comprises a contact charging means brought into contact with the photosensitive drum surface to charge the photosensitive drum primarily.

75. The apparatus unit according to claim 74, wherein said contact charging means comprises a charging roller.

76. The apparatus unit according to claim 51, which further comprises a cleaning means provided in contact with the electrostatic latent image bearing member surface to clean the surface of said electrostatic latent image bearing member.

77. The apparatus unit according to claim 76, wherein said cleaning means comprises a cleaning blade.

* * * * *